US008967960B2

(12) United States Patent
Guénard

(10) Patent No.: US 8,967,960 B2
(45) Date of Patent: Mar. 3, 2015

(54) STACK ROTOR WITH TIE ROD AND BOLTED FLANGE AND METHOD

(75) Inventor: Denis Guillaume Jean Guénard, Florence (IT)

(73) Assignee: Nuovo Pignone, S.p.A., Florence (IT)

( * ) Notice: Subject to any disclaimer, the term of this patent is extended or adjusted under 35 U.S.C. 154(b) by 887 days.

(21) Appl. No.: 13/086,730

(22) Filed: Apr. 14, 2011

(65) Prior Publication Data

US 2011/0262284 A1 Oct. 27, 2011

(30) Foreign Application Priority Data

Apr. 21, 2010 (IT) ..... MI2010A0684

(51) Int. Cl.

| | |
|---|---|
| ***F04D 29/04*** | (2006.01) |
| ***F04D 29/60*** | (2006.01) |
| ***B21K 25/00*** | (2006.01) |
| ***F04D 29/28*** | (2006.01) |
| ***F04D 17/12*** | (2006.01) |
| ***F04D 29/62*** | (2006.01) |

(52) U.S. Cl.

CPC ..... *F04D 29/284* (2013.01); *F04D 17/122* (2013.01); *F04D 29/624* (2013.01)

USPC ..... 415/198.1; 415/216.1; 29/889.2; 29/889.21

(58) Field of Classification Search

CPC ..... F01D 5/025; F01D 5/026; F01D 5/066; F04D 17/122; F04D 17/125; F04D 29/20; F04D 29/266; F04D 9/285; F04D 29/286; F04D 29/624; F04D 29/626

USPC ..... 415/198.1, 199.1, 199.2, 199.3, 216.1; 416/198 A, 244 R, 244 A; 29/525.01, 29/889, 889.2, 889.21

See application file for complete search history.

(56) References Cited

U.S. PATENT DOCUMENTS

| | | | | |
|---|---|---|---|---|
| 2,650,017 | A | 8/1953 | Pederson et al. | |
| 2,654,565 | A * | 10/1953 | Feilden | 416/201 R |
| 2,861,823 | A * | 11/1958 | Perry | 416/135 |
| 3,010,643 | A | 11/1961 | Ricketts | |
| 3,184,153 | A | 5/1965 | Zech et al. | |
| 3,749,516 | A | 7/1973 | Samurin et al. | |
| 3,976,399 | A * | 8/1976 | Schmoch | 416/201 R |
| 4,993,917 | A * | 2/1991 | Kulle et al. | 415/105 |
| 5,537,814 | A * | 7/1996 | Nastuk et al. | 60/796 |
| 7,452,188 | B2 * | 11/2008 | Bouchard | 416/204 R |

FOREIGN PATENT DOCUMENTS

| | | | |
|---|---|---|---|
| FR | 937533 | A | 8/1948 |
| FR | 2406121 | A1 | 5/1979 |

OTHER PUBLICATIONS

Italian Search Report and Written Opinion issued in connection with IT Application No. MI2010A000684, Dec. 1, 2010.

* cited by examiner

*Primary Examiner* — Edward Look
*Assistant Examiner* — Jason Davis
(74) *Attorney, Agent, or Firm* — GE Global Patent Operation

(57) ABSTRACT

Method and rotor for a compressor. The rotor includes a solid first stub having a first end configured to engage with a corresponding bearing and a second end having a flange configured to be attached by bolts to a corresponding flange of a first impeller of the compressor; a tie rod configured to pass through the first impeller of the compressor; a nut being configured to engage a threaded region of the first end of the tie rod; and a solid second stub having a first end configured to receive the threaded portion of the second end of the tie rod and a second end configured to engage with a corresponding bearing. The tie rod does not contact the solid first stub.

12 Claims, 8 Drawing Sheets

STACK ROTOR WITH TIE ROD AND BOLTED FLANGE AND METHOD

BACKGROUND

1. Technical Field

Embodiments of the subject matter disclosed herein generally relate to methods and systems and, more particularly, to mechanisms and techniques for preventing a leakage to atmosphere of a compressed medium by a stack rotor.

2. Discussion of the Background

Turbo-machines are used extensively in the oil and gas industry for performing fluid compression, transformation of electrical energy into mechanical energy, fluid liquefaction, etc. One such machine is a compressor. Modern compressors include plural stages (e.g., plural impellers connected in series) that are configured to compress a medium, each stage compressing the medium in a certain pressure range. A single rotor (made for example, as a single solid piece of metal) may be used to hold the plural impellers. However, advanced compressors use a more complex rotor that has a couple of components in order to achieve higher pressure ratio and delivered head.

With regard to FIG. 1, such a complex rotor 10 (which is disclosed in U.S. Pat. No. 3,749,516, the entire disclosure of which is incorporated herein by reference) may include stubs 12 and 14 that sandwich between them plural impellers 16, 18, 20, and 22. In order to hold tight the impellers 16, 18, 20, and 22 one to the other, a thru-bolt 30 is threaded and attached (screwed) at both ends into the stubs 12 and 14.

Stub 12 is attached to first impeller 16 via a longitudinal pin 24 while stub 14 is attached to the impeller 22 via a key 26 along a radial direction. The pin 24 and key 33 provide a driving connection between the impeller assembly and the stubs 12 and 14. It is noted that the thru-bolt is first screwed into the stub 12, then impellers 16, 18, 20, and 22 are added to the thru-bolt 30, and finally the stub 14 is screwed into the thru-bolt 30. For this reason, the pins 24 extend along an axial direction of the rotor and the keys 26 extend along a radial direction of the rotor. However, such a rotor may be difficult to compress, i.e., to connect impeller 22 to stub 14 and apply an appropriate load as an exact alignment between impeller 22 and stub 14 is needed for inserting key 26.

Other existing rotors have a hollow rotor through which the thru-bolt extends fully under the bearing and seal zone and have therefore an extremity accessible from outside of rotor. In order to apply the necessary load to the thru-bolt, one end of the thru-bolt is threaded into the rotor while the other end communicates with an opening in the rotor. This arrangement creates an additional potential leaking path for the compressed medium, between the thru-bolt and the hollow rotor, which is a potential hazard especially if the compressed medium is different from air (e.g., asphyxiating, toxic, explosive or a combination of all). The potential leaking path appears as the medium compressed by the compressor is at high pressure and thus, part of the compressed medium may escape by the rotor towards an area of low pressure. Systems to seal such type of configuration can be provided but they will nevertheless have the potential to fail.

Accordingly, it would be desirable to provide systems and methods that provide the operator of the machine with easy access to the thru-bolt and also does not leak between the thru-bolt and the rotor or other parts of the machine.

SUMMARY

According to an exemplary embodiment, there is a rotor for a compressor. The rotor includes a solid first stub having a first end configured to engage with a corresponding bearing and a second end having a flange configured to be attached by bolts to a corresponding flange of a first impeller of the compressor; a tie rod configured to pass through the first impeller of the compressor, the tie rod having a first end having a threaded region and a second end having a threaded portion, the first end facing the second end of the solid first stub; a nut being configured to engage the threaded region of the first end of the tie rod and to apply a pre-load to the tie rod and the first impeller of the compressor; and a solid second stub having a first end configured to receive the threaded portion of the second end of the tie rod and a second end configured to engage with a corresponding bearing. The tie rod does not contact the solid first stub.

According to another exemplary embodiment, there is a compressor that includes a casing; first and second bearings provided at opposite ends of the casing; a solid first stub having a first end configured to engage with the first bearing and a second end having a flange; a first impeller having a flange configured to be attached by bolts to the flange of the solid first stub; a second impeller configured to be attached to the first impeller; a tie rod configured to pass through the first and second impellers, the tie rod having a first end having a threaded region and a second end having a threaded portion, the first end facing the second end of the solid first stub; a nut being configured to engage the threaded region of the first end of the tie rod and to apply a pre-load to the tie rod and the first and second impellers of the compressor; and a solid second stub having a first end configured to receive the threaded portion of the second end of the tie rod and a second end configured to engage with the second bearing, the solid second stub being attached to the second impeller. The tie rod does not contact the solid first stub. According to still another exemplary embodiment, there is a method of assembling a rotor of a compressor that includes solid first and second stubs and plural impellers. The method includes attaching a tie rod to the solid second stub; sliding the plural impellers over the tie rod such that the last impeller contacts the solid second stub, a following impeller contact the last impeller and so on until the first impeller touches a second impeller and is free on one side; tightening a nut on the one side of the first impeller on the tie rod to hold all the impellers in contact with each other and with the solid second stub; contacting the solid first stub to the first impeller such that the tie rod does not touch the solid first stub; and attaching the solid first stub to the first impeller by inserting bolts into flanges of the solid first stub and the first impeller.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of a multistage centrifugal compressor. However, the embodiments to be discussed next are not limited to this compressor, but may be applied to other type of compressors, turbines, pumps, etc.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an exemplary embodiment, a rotor of a machine includes three segments connected to each other. The first segment is a solid first stub, the second segment includes one or more impellers and the third segment includes a solid second stub. The one or more impellers are sandwiched between the solid first and second stubs. To maintain the one or more impellers in tight contact with each other, a tie rod is screwed into the solid second stub through the one or more impellers. A nut is attached at the other end of the tie rod and the tie rod is preloaded with a desired tension by tightening the nut. The solid first stub covers the nut and a corresponding end of the tie rod. The solid first and second stubs are configured to come into contact with bearings for supporting a rotation of the rotor. The machine may be a compressor, an expander, a pump, etc.

Figure 1:
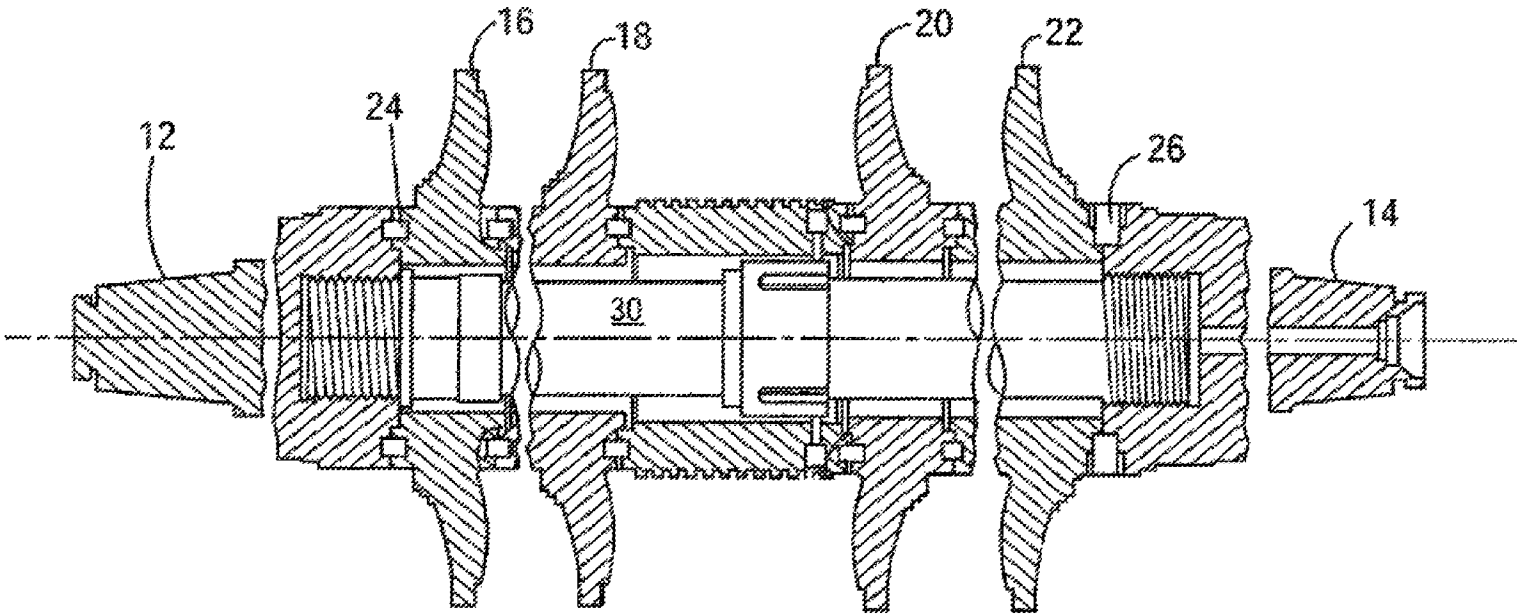
Figure 1 PRIOR ART
FIG. 1 is a schematic diagram of a conventional rotor of a compressor.
Figure 2:
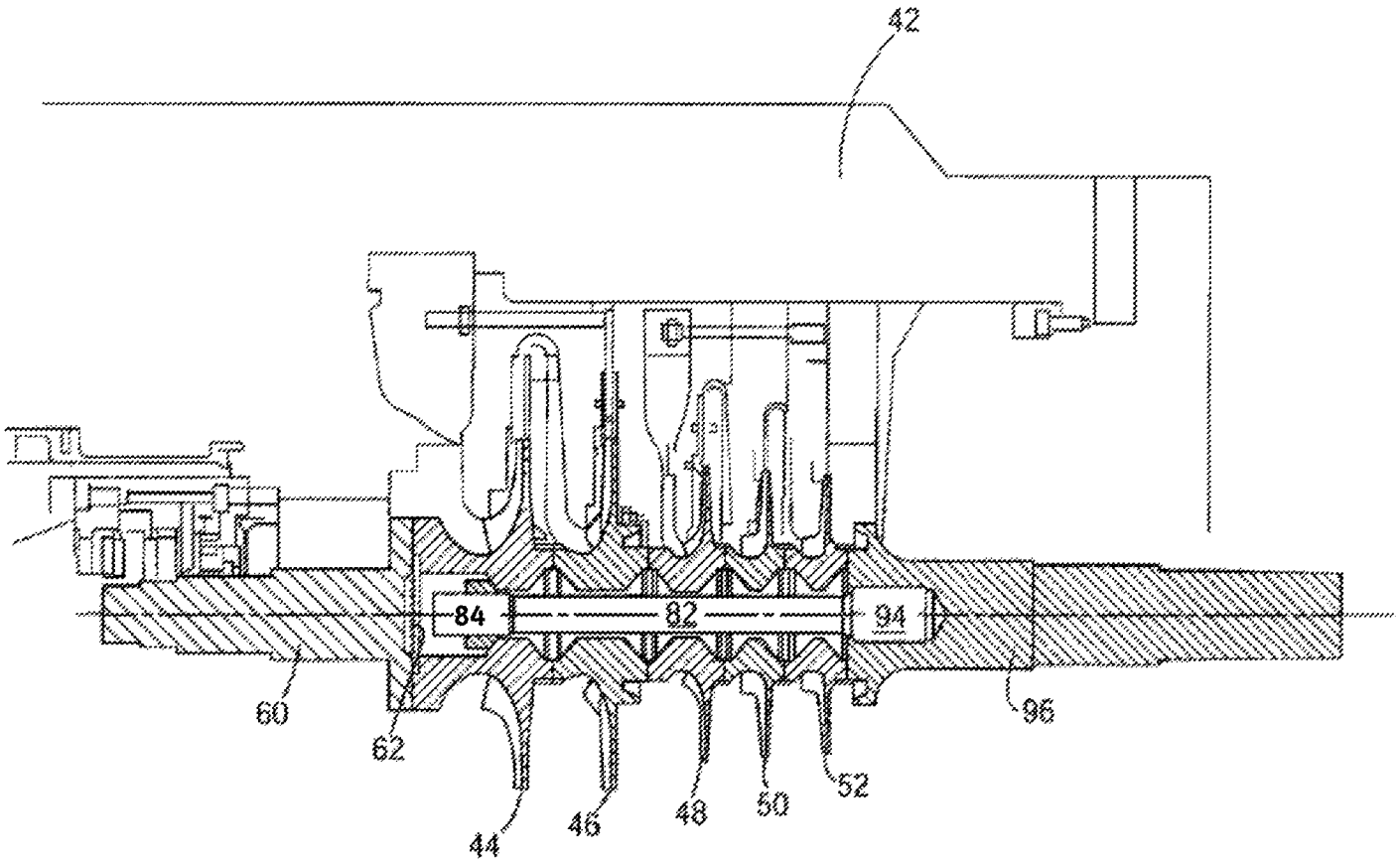
FIG. 2 is an overall view of a novel rotor for a compressor according to an exemplary embodiment.

According to an exemplary embodiment illustrated in FIG. 2, a compressor 40 includes a casing 42 that accommodates one or more impellers. FIG. 2 shows a set of five impellers, 44, 46, 48, 50, and 52. However, it is noted that the exemplary embodiments discussed herein apply to a compressor having one or more impellers and is not limited to five impellers as used here as an example. Also, a compressor is illustrated in FIG. 2 for simplicity but the exemplary embodiments apply to other machines or types of compressors.

Figure 3:
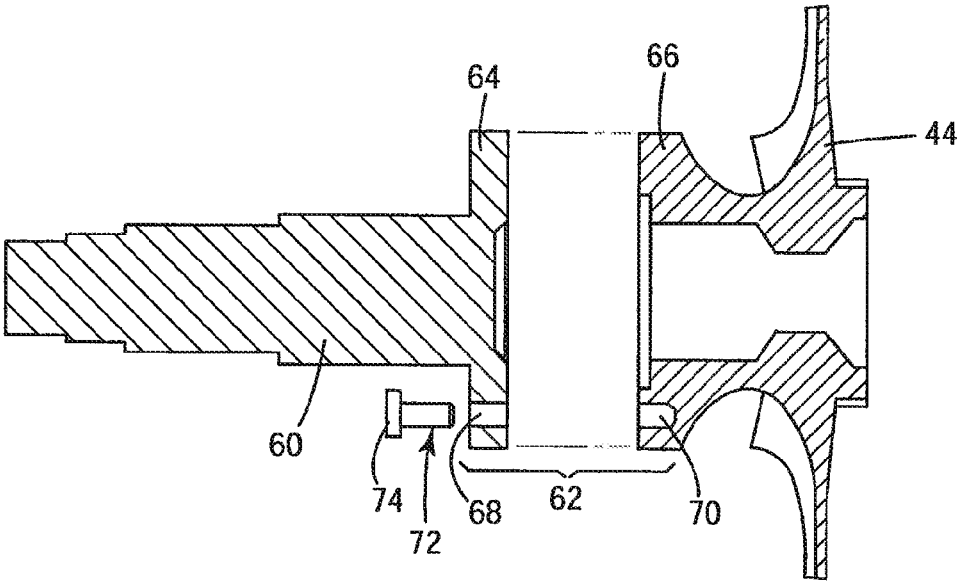
FIG. 3 is a schematic diagram of a solid first stub that connects to an impeller according to an exemplary embodiment.

A solid first stub 60 is configured to be attached to the first impeller 44. An interface 62 between the solid first stub 60 and the first impeller 44 may include various elements for achieving the connection between the solid first stub 60 and the impeller 44. For example, as shown in FIG. 3, interface 62 may include a flange 64 that is attached to the solid first stub 60 and a flange 66 that is attached to the first impeller 44. Flanges 64 and 66 are configured to be attached to each other. According to an exemplary embodiment, flanges 64 and 66 have one or more holes 68 and 70 in which one or more bolts 72 are provided. Bolt 72 may have a threaded region that threads into a corresponding threaded region inside hole 70 of flange 66. Alternatively, flange 66 may have a groove set up in such a way that an end of bolt 72 is accessible from outside (hole 68 goes all the way through flange 66). In this case, the connection of the flange is achieved by using a nut applied to the end of screw 72. A benefit of this exemplary arrangement is to avoid filleting the flange 66 when a material not suitable for this type of machining is used. Another end 74 of bolt 72 may completely be accommodated by hole 68, by having, for example, a first part of hole 68 drilled with a larger diameter. Alternately, the end 74 of bolt 72 may stay outside flange 64.

Figure 4:
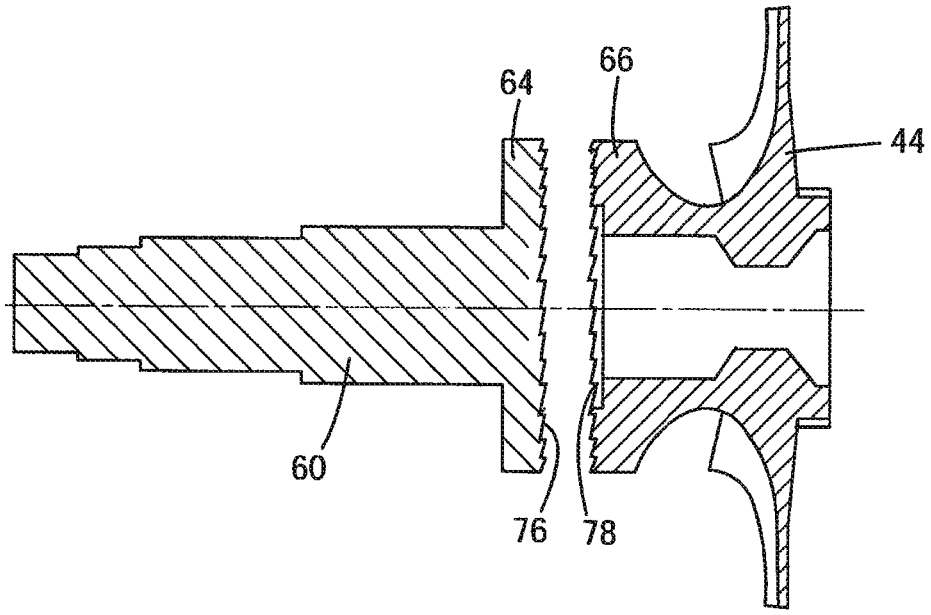
FIG. 4 is a schematic diagram of a solid first stub that connects to an impeller according to an exemplary embodiment.

According to another exemplary embodiment shown in FIG. 4, a front surface 76 of flange 64 and a corresponding front surface 78 of flange 66 may be connected to each other by providing them with teeth that mesh together, e.g., a Hirth or curvic connection (a curvic connection of coupling has precision face splines with curved radial teeth of contact depth. They are used for joining two or more members to form a single operating unit). According to another exemplary embodiment, flanges 64 and 66 are connected to each other only by bolts 74. According to still another embodiment, both Hirth mechanism and bolts may be used to connect the two flanges.

Figure 5:
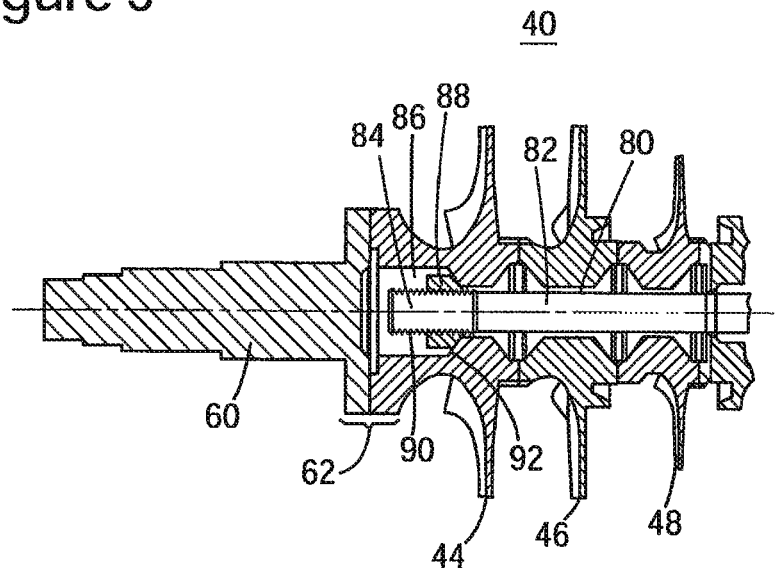
FIG. 5 is a schematic diagram of a tie rod disposes inside plural impellers according to an exemplary embodiment.

Returning to FIG. 2, impellers 44, 46, 48, 50, and 52 may be connected to each other by bolts, by Hirth or curvic connections, by both of them, or by other known mechanisms in the art. The same is true for the connections between impellers and the first and second stubs. Each impeller has an inner hole that communicates with the inner holes of the neighboring impellers. Thus, as shown more clearly in FIG. 5, a passage 80 is formed inside impellers 44 to 52, in a central region of the impellers. FIG. 5 also shows that a tie rod 82 is inserted inside the passage 80. A first end 84 of the tie rod 82 is housed by a cavity 86 formed in the first impeller 44. A nut 88 is provided on a threaded region 90 of the first end 84. The nut 88 is screwed until it contacts an inside part 92 of the first impeller 44. Thus, in one application, the tie rod 82 is configured to not touch the passage 80 formed by the impellers. A predetermined tension is applied to the tie rod 82 by appropriately tightening nut 88. As would be recognized by those skilled in the art, other mechanisms may be used to press the impellers one against the other.

Figure 6:
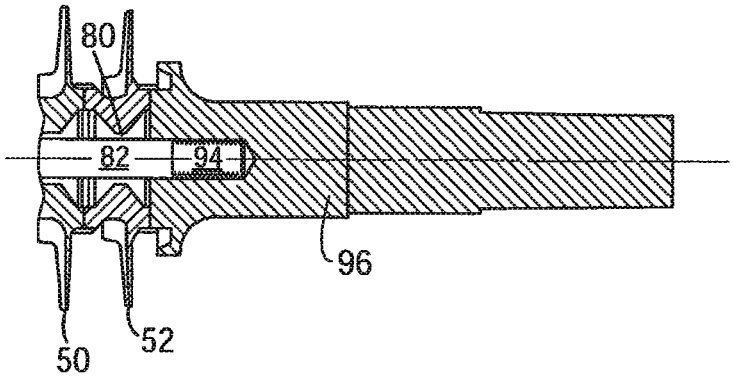
FIG. 6 is a schematic diagram of an impeller connected to a solid second stub according to an exemplary embodiment.

The other end 94 of the tie rod 82 is shown in FIG. 6 as being screwed into a solid second stub 96. As discussed above with regard to FIG. 5, the tie rod 82 may be configured to not contact passage 80. In other words, in one application, the tie rod 82 does not contact any of the impellers of the machine.

Next, the assembly of the impellers 44 to 52 is discussed with regard to FIGS. 5 and 6. Initially, the tie rod 82 is screwed into the solid second stub 96 until the tie rod 82 is fixed, i.e., cannot be further rotated. Then, the last stage 52 is added to contact the solid second stub 96. One by one, all stages are added on the tie rod 82 until the first stage 44 is positioned as shown in FIG. 5. In one application, a Hirth coupling is provided between each two adjacent stages. In another application, a Hirth coupling is provided between the solid first stub 60 and the first impeller 44 and/or between the last stage 52 and the solid second stub 96.

After adding the first impeller 44 as shown in FIG. 5, nut 88 is screwed onto the tie rod 82 so that a predetermined tension is applied to the tie rod 82. The applied tension ensures that the various impellers of the compressor do not slide one relative to the other when the compressor is functional. Also, the applied pre-load ensures that all the impellers trough which the tie rod passes rotate together with the solid second stub 96. Finally, the solid first stub 60 is attached to the first impeller 44, thus sealing cavity 86 in which the first end 84 of the tie rod 82 is present. In this way, no gas that is compressed by the impellers leaks past the tie rod as in traditional devices.

Thus, in one exemplary embodiment, the tie rod 82 is fully contained inside the rotor, between the solid first and second stubs 60 and 96.

Figure 7:
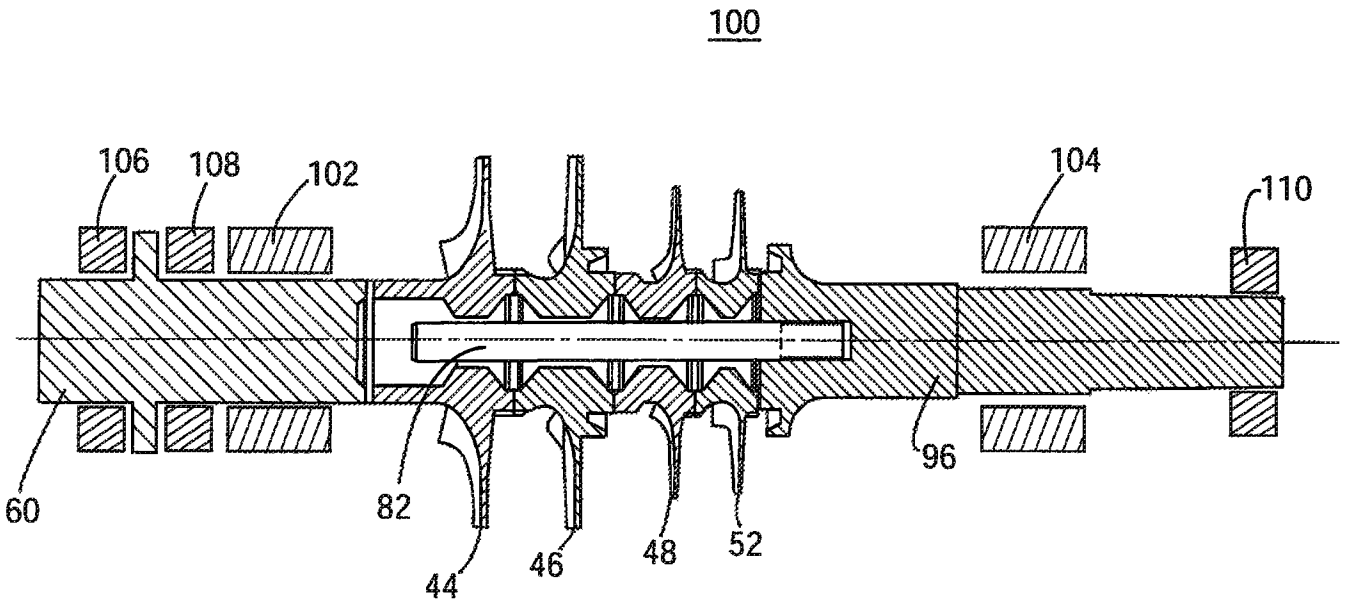
FIG. 7 is a schematic diagram of a compressor according to an exemplary embodiment.

According to an exemplary embodiment shown in FIG. 7, a compressor 100 may include four impellers 44, 46, 48, and 52, the solid first stub 60, the solid second stub 96, and the tie rod 82. In addition, the compressor 100 may include a dry seal unit 102 that seals a flow of fluid along the solid first stub 60 and a dry seal unit 104 that seals a flow of fluid along the solid second stub 96. The fluid that is compressed by the impellers of the compressor may escape along the rotor and the dry seal units are configured to minimize such a flow. The dry seal units are configured to receive another fluid under pressure and to interpose this other fluid under pressure between the escaping compressed fluid and the environment. According to the exemplary embodiment shown in FIG. 7, the tie rod 82 does not extend past the dry seal units 102 and 104.

According to the exemplary embodiment shown in FIG. 7, bearings 106, 108 and 110 may be provided at ends of the solid first and second stubs 60 and 96. For example, bearing 106 and 110 may be support bearings, i.e., bearings that support a rotation of the rotor (60, 44, 46, 48, 52, and 96) while bearings 108 may prevent an axial displacement of the rotor. In one application, both the bearings and the dry seals are configured to face the solid first and second stubs while the impellers are configured to accommodate but not touch the tie rod.

With this configuration, a tie rod that is not as long as the rotor is strong enough to transfer torque to the impellers and to overcome rotor axial forces generated by axial thrust of impellers. In fact, the radial room available for tie-rod under impellers is much larger than the one available under seals or bearings. Not extending the tie-rod under seals allows the manufacturer to use a bigger diameter tie-rod with the possibility to apply higher axial pre-load and to have a stiffer tie rod that better resists at potential harmful vibrations. Further, the zone of dry gas seal can be the hottest zone in the compressor due to both the friction of seals with a very small leakage and the fact that those seals are normally supplied with filtered but hot gas from compressor to avoid potential condensate formation. Passage of the tie-rod under the dry gas seal would therefore create a thermal differential growth between the rotor under the seal and the tie-rod, with potential for thermal fatigue of tie rod.

Figure 8:
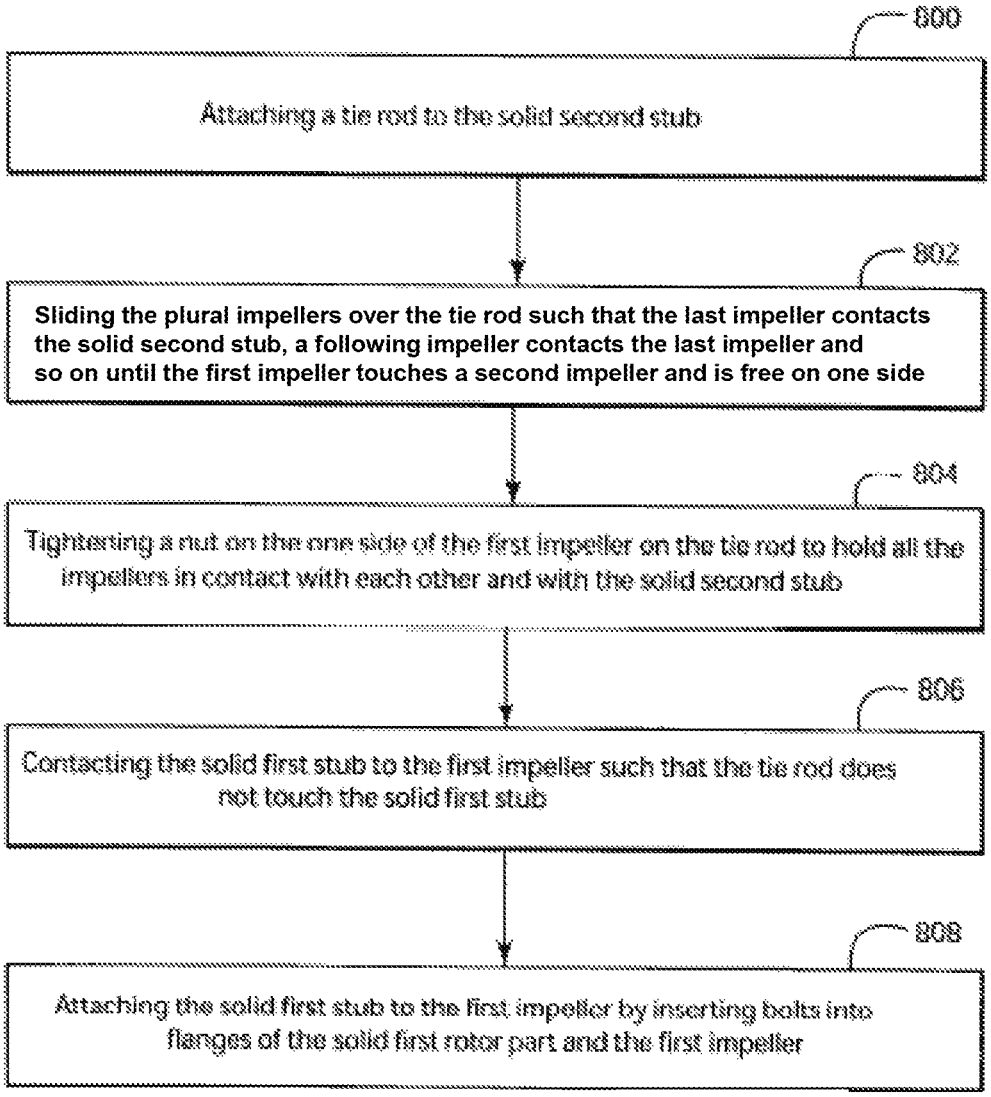
FIG. 8 is a flow chart illustrating a method for assembling a compressor according to an exemplary embodiment.

According to an exemplary embodiment illustrated in FIG. 8, there is a method of assembling a rotor of a compressor that includes solid first and second stubs and plural impellers. The method includes a step 800 of attaching a tie rod to the solid second stub, a step 802 of sliding the plural impellers over the tie rod such that the last impeller contacts the solid second stub, a following impeller contacts the last impeller and so on until the first impeller touches a second impeller and is free on one side, a step 804 of tightening a nut on the one side of the first impeller on the tie rod to hold all the impellers in contact with each other and with the solid second stub, a step 806 of contacting the solid first stub to the first impeller such that the tie rod does not touch the solid first stub, and a step 808 of attaching the solid first stub to the first impeller by inserting bolts into flanges of the solid first stub and the first impeller.

The disclosed exemplary embodiments provide a system and a method for preventing leakage of a compressed medium from a compressor. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein. This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

The invention claimed is:

1. A rotor for a compressor, the rotor comprising:

a solid first stub having a first end configured to engage with a corresponding bearing and a second end having a flange configured to be attached by bolts to a corresponding flange of a first impeller of the compressor and wherein the solid first stub is not hollow, wherein;

a tie rod configured to pass through the first impeller of the compressor, the tie rod having a first end having a threaded region and a second end having a threaded portion, the first end facing the second end of the solid first stub;

a nut being configured to engage the threaded region of the first end of the tie rod and to apply a pre-load to the tie rod and the first impeller of the compressor; and a solid second stub having a first end configured to receive the threaded portion of the second end of the tie rod and a second end configured to engage with a corresponding bearing, and wherein the solid second stub is not hollow, wherein the tie rod does not contact the solid first stub.

2. The rotor of claim 1, wherein the flange of the solid first stub and the corresponding flange of the first impeller have a teeth mechanism coupling them to each other.

3. The rotor of claim 1, wherein the first impeller is configured to have a cavity that accommodates the first end of the tie rod and the nut such that the first end of the tie rod does not touch the first impeller, the flange of the first impeller or the solid first stub.

4. A compressor comprising:

a casing;

first and second bearings provided at opposite ends of the casing;

a solid first stub having a first end configured to engage with the first bearing and a second end having a flange and wherein the solid first stub is not hollow;

a first impeller having a flange configured to be attached by bolts to the flange of the solid first stub;

a second impeller configured to be attached to the first impeller;

a tie rod configured to pass through the first and second impellers, the tie rod having a first end having a threaded region and a second end having a threaded portion, the first end facing the second end of the solid first stub;

a nut being configured to engage the threaded region of the first end of the tie rod and to apply a pre-load to the tie rod and the first and second impellers of the compressor; and a solid second stub having a first end configured to receive the threaded portion of the second end of the tie rod and a second end configured to engage with the second bearing, the solid second stub being attached to the second impeller and wherein the solid second stub is not hollow, wherein the tie rod does not contact the solid first stub.

5. The compressor of claim 4, further comprising:

a dry gas seal configured to prevent a leaked compressed medium from the first impeller to escape outside the casing, wherein the dry gas seal is placed between the first end and the flange of the solid first stub.

6. The compressor of claim 4, wherein the flange of the solid first stub and the corresponding flange of the first impeller have a Hirth mechanism coupling them to each other.

7. The compressor of claim 4, wherein the first impeller is configured to have a cavity that accommodates the first end of the tie rod and the nut such that the first end of the tie rod does not touch the first impeller, the flange of the first impeller or the solid first stub.

8. The compressor of claim 4, wherein the tie rod is configured to form a space with, but not to touch the first and second impellers.

9. The compressor of claim 4, further comprising:

a first dry gas seal placed to face the solid first stub, between the first bearing and the first impeller; and a second dry gas seal placed to face the solid second stub, between the second bearing and the second impeller, wherein a length of the tie rod is shorter than a distance between the first and second dry gas seals.

10. A method of assembling a rotor of a compressor that includes solid first and second stubs and plural impellers and wherein the solid first stub and the solid second stub are not hollow, the method comprising:

attaching a tie rod to the solid second stub;

sliding the plural impellers over the tie rod such that the last impeller contacts the solid second stub, a following impeller contact the last impeller and so on until the first impeller touches a second impeller and is free on one side;

tightening a nut on the one side of the first impeller on the tie rod to hold all the impellers in contact with each other and with the solid second stub;

contacting the solid first stub to the first impeller such that the tie rod does not touch the solid first stub; and attaching the solid first stub to the first impeller by inserting bolts into flanges of the solid first stub and the first impeller.

11. The method of claim 10, wherein the flange of the solid first stub and the corresponding flange of the first impeller have a teeth mechanism coupling them to each other.

12. The rotor of claim 10, wherein the first impeller is configured to have a cavity that accommodates the first end of the tie rod and the nut such that the first end of the tie rod does not touch the first impeller, the flange of the first impeller or the solid first stub.

* * * * *